US007866505B2

(12) United States Patent
Perlman et al.

(10) Patent No.: US 7,866,505 B2
(45) Date of Patent: Jan. 11, 2011

(54) PORTABLE AND LOCKABLE STORAGE CONTAINER

(75) Inventors: Robert D. Perlman, Weston, FL (US); Jose Pelaez, Miami, FL (US); Robert E. Higgins, Davie, FL (US)

(73) Assignee: Blue Chip Group, LLC, Miami, FL (US)

( * ) Notice: Subject to any disclaimer, the term of this patent is extended or adjusted under 35 U.S.C. 154(b) by 965 days.

(21) Appl. No.: 11/704,658

(22) Filed: Feb. 9, 2007

(65) Prior Publication Data

US 2008/0190931 A1 Aug. 14, 2008

Related U.S. Application Data

(63) Continuation-in-part of application No. 29/239,940, filed on Oct. 6, 2005, now Pat. No. Des. 539,540.

(51) Int. Cl.
*B65D 43/22* (2006.01)
*B65D 55/14* (2006.01)
*B65D 43/16* (2006.01)

(52) U.S. Cl. ..... 220/835; 70/159; 220/318; 220/324; 220/326; 220/756

(58) Field of Classification Search ..... 220/835, 220/318, 315, 324, 326, 756; 70/159, 162
See application file for complete search history.

(56) References Cited

U.S. PATENT DOCUMENTS 1,026,649 A 5/1912 Beshore
1,905,955 A * 4/1933 Waehner ..... 220/814
2,755,748 A 7/1956 Abell, Jr.
3,858,531 A 1/1975 Rubinstein
4,074,918 A 2/1978 Kotzin, Jr.
4,520,945 A * 6/1985 Hodge ..... 220/315
4,573,332 A * 3/1986 Ma ..... 70/30
4,682,481 A * 7/1987 Dimmick et al. ..... 70/14
4,971,390 A 11/1990 McGinley
5,085,341 A * 2/1992 Hodge ..... 220/811
D335,378 S 5/1993 Mariol
D345,850 S 4/1994 Nakaue
5,329,865 A 7/1994 McWard
5,531,082 A * 7/1996 Wolk et al. ..... 70/63
D374,966 S 10/1996 Matassa
5,564,583 A * 10/1996 Kelley et al. ..... 220/23.83

(Continued)

*Primary Examiner*—Anthony Stashick
*Assistant Examiner*—Niki M Eloshway
(74) *Attorney, Agent, or Firm*—GrayRobinson, P.A.; Daniel C. Crilly

(57) ABSTRACT

A portable and lockable storage container includes a lid, a base, a locking mechanism, and a securing cable. The lid defines a lid aperture therein proximate a front edge portion of the lid. The base is hingedly connected to the lid along at least part of rear edge portions of the base and the lid. The lid and the base define a chamber when the lid is closed. The locking mechanism is connected to the base proximate a front edge portion of the base. The front edge portion of the base substantially aligns with the front edge portion of the lid when the lid is closed. The securing cable is designed to allow at least part of a first end portion of the securing cable to pass through the lid aperture and cooperate with the locking mechanism to retain the lid in a closed position.

20 Claims, 5 Drawing Sheets

U.S. PATENT DOCUMENTS 5,632,165 A * 5/1997 Perry ..... 70/30
6,085,871 A 7/2000 Kerr et al.
D441,170 S 4/2001 Ciesko et al.
D446,011 S 8/2001 Ogilvie et al.
6,305,199 B1 * 10/2001 Igelmund ..... 70/58
6,581,424 B2 6/2003 Oliver
6,880,717 B1 * 4/2005 O'Conor ..... 220/318
2004/0178196 A1 * 9/2004 Sholinder ..... 220/4.33
2006/0032860 A1 * 2/2006 Hase ..... 220/831

* cited by examiner

PORTABLE AND LOCKABLE STORAGE CONTAINER

CROSS REFERENCE TO RELATED APPLICATIONS

This application is a continuation-in-part of U.S. Design application Ser. No. 29/239,940 filed Oct. 6, 2005 now U.S. Pat. No. D539540, entitled "Storage Container," the entire contents of which is incorporated herein by this reference and upon which the present application claims priority under 35 U.S.C. §120.

BACKGROUND OF THE INVENTION

1. Field of the Invention

The present invention relates generally to portable and lockable storage containers and, more particularly, to a portable and lockable storage, container that is attachable to an object by means of a securing cable that is also used to retain a lid of the storage container in a closed position.

2. Description of the Prior Art

Securing personal possessions is a high priority for everyone. Most people carry numerous valuable objects with them at all times (e.g., a purse, a wallet, glasses, jewelry, a watch, money, keys, a cell phone, a music player, a camera, etc.). Because these items are so important, they are usually kept on a person's body or in a relatively secure location, such as a locker, a desk, an office, or home.

Problems arise when someone has a need to leave his or her valuable belongings in a location that is not secured. For instance, when an individual visits a public beach or swimming pool and desires to go into the water, he or she is forced to choose among carrying the valuables into the water, storing them in a rented locker, or hiding them in a "non-obvious" location. Each of these possible solutions has unique problems.

First, if the belongings are carried into the water, they will obviously get wet. Wet paper money must dry out before it is used and is more likely to be torn. Many car keys for newer model cars have integrated electronic recognition circuitry within the key itself, which risks being damaged if submerged in water. Additionally, there is the danger of unknowingly losing the item while underwater. Some swimsuits include a waterproof, sealable, plastic pocket in which personal belongings, such as keys and/or money, may be stored while the individual wearing the suit goes into the water. However, the pocket is usually very small and is heavily dependent upon proper sealing to provide its waterproof characteristic.

Relying on the use and/or availability of storage lockers is also problematic. Storage lockers are not always provided and, when offered, are limited in number. Even if lockers are available, they are often located a great distance away from the person's final destination (e.g., the ocean, pool, tennis court, etc.). If the person later desires to retrieve something from the locker, he/she must trek all the way back to the locker. Additionally, many rented lockers charge a usage fee that is collected by depositing an appropriate amount of coins into a vending slot in the locker, which causes a key retained in the locker's locking mechanism to be released. When the key is reinserted to unlock the locker, the key is once again retained, requiring the renter to deposit additional coins to continue using the locker. The key itself is often imprinted with the actual locker number so that anyone finding the key has access to the stored goods. Thus, the renter faces the original problem of needing to secure valuable goods because he/she must now carry around, or attempt to hide, the key.

Given the drawbacks of carrying valuables with them into the water or storing the valuables in a locker, many people just try to hide the valuable items such that they are not in plain view (e.g., inside a shoe or other article of clothing, under a blanket or towel, etc.). The problem with this solution is that everyone generally knows where to look for valuables left unattended, so there is a great risk of theft.

Therefore, a need exists for, among other things, a portable and lockable storage container that is attachable to a larger, external object (e.g., a tree, picnic table, lounge chair, etc.) by means of a securing cable, which overcomes the shortcomings of the prior art.

DETAILED DESCRIPTION OF EXEMPLARY EMBODIMENT(S)

Figure 1:
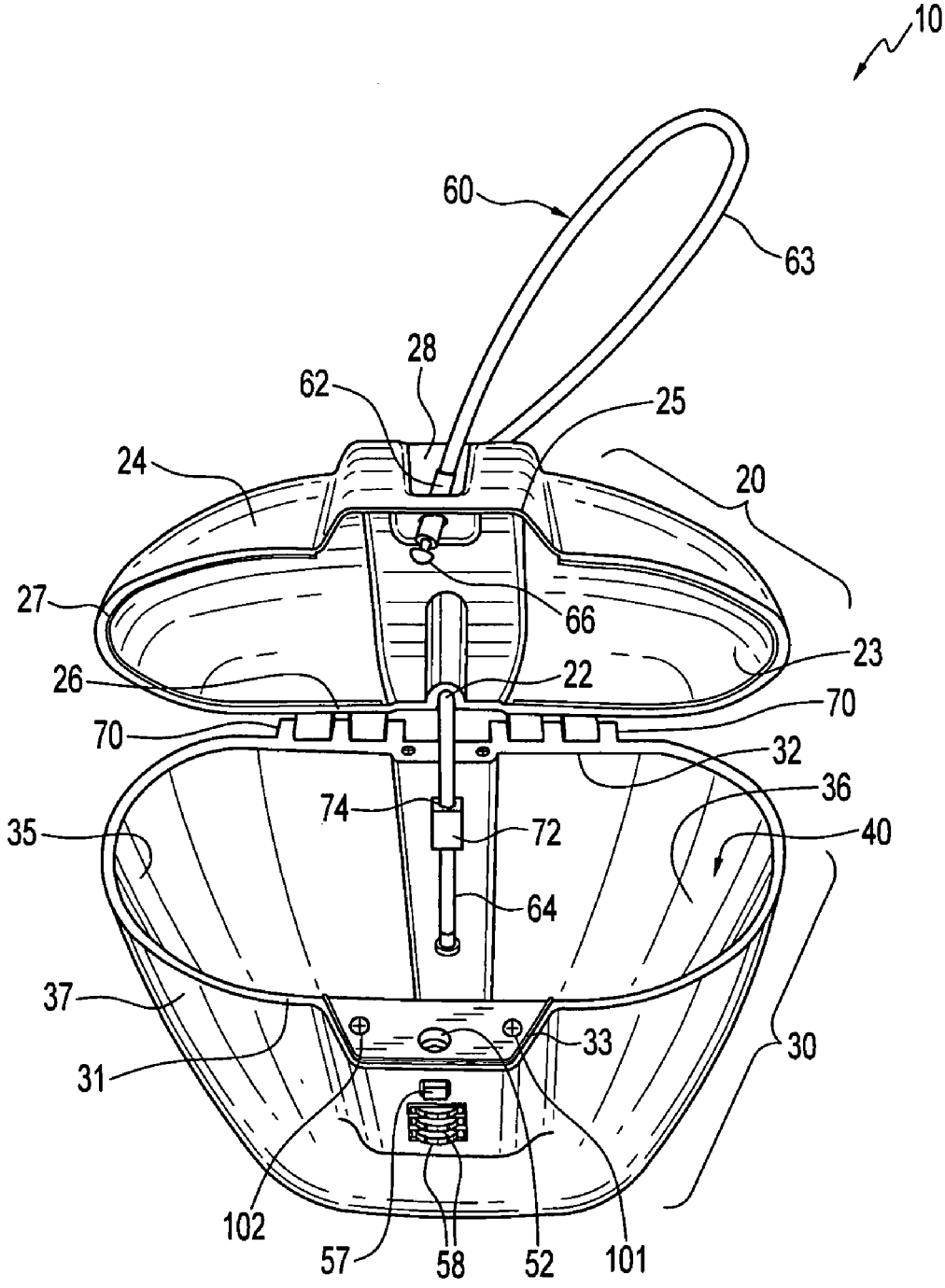
FIG. 1 is a top, front perspective view of an exemplary portable and lockable storage container with its lid in an open position, in accordance with one embodiment of the present invention.

Before describing in detail exemplary embodiments that are in accordance with the present invention, it should be observed that the embodiments reside primarily in combinations of apparatus components related to implementing a portable and lockable storage container that is attachable to an external object by means of a securing cable. Accordingly, the components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms, such as "first" and "second," "top" and "bottom," "front" and "rear," and the like, may be used solely to distinguish one entity or element from another entity or element without necessarily requiring or implying any physical or logical relationship or order between such entities or elements. The terms "comprises," "comprising," or any other variation thereof are intended to cover a non-exclusive inclusion, such that a process, method, article, or apparatus that comprises a list of elements does not include only those elements, but may include other elements not expressly listed or inherent to such process, method, article, or apparatus. The term "plurality of" as used in connection with any object or action means two or more of such object or action. A claim element proceeded by the article "a" or "an" does not, without more constraints, preclude the existence of additional identical elements in the process, method, article, or apparatus that includes the element.

Generally, the present invention encompasses a portable and lockable storage container that includes a lid, a base, a locking mechanism, and a securing cable. The lid defines a lid aperture therein proximate a front edge portion of the lid. The base is hingedly connected to the lid along at least part of rear edge portions of the base and the lid. The lid and the base define a chamber when the lid is closed. The locking mechanism is connected to the base proximate a front edge portion of the base. The front edge portion of the base substantially aligns with the front edge portion of the lid when the lid is closed. The securing cable is designed to allow at least part of a first end portion of the securing cable to pass through the lid aperture and cooperate with the locking mechanism to retain the lid in a closed position.

In one embodiment, the locking mechanism includes a spring-biased latch and an access aperture, and the securing cable includes an annular recess proximate a locking end portion of the cable. When the lid is in the closed position, the access aperture substantially aligns with the lid aperture. The lid is secured by inserting the locking end portion of the securing cable through both the lid aperture and the access aperture. An annular recess in the locking end portion of the securing cable receives at least part of the spring-biased latch, thereby retaining the lid in the closed position.

Figure 4:
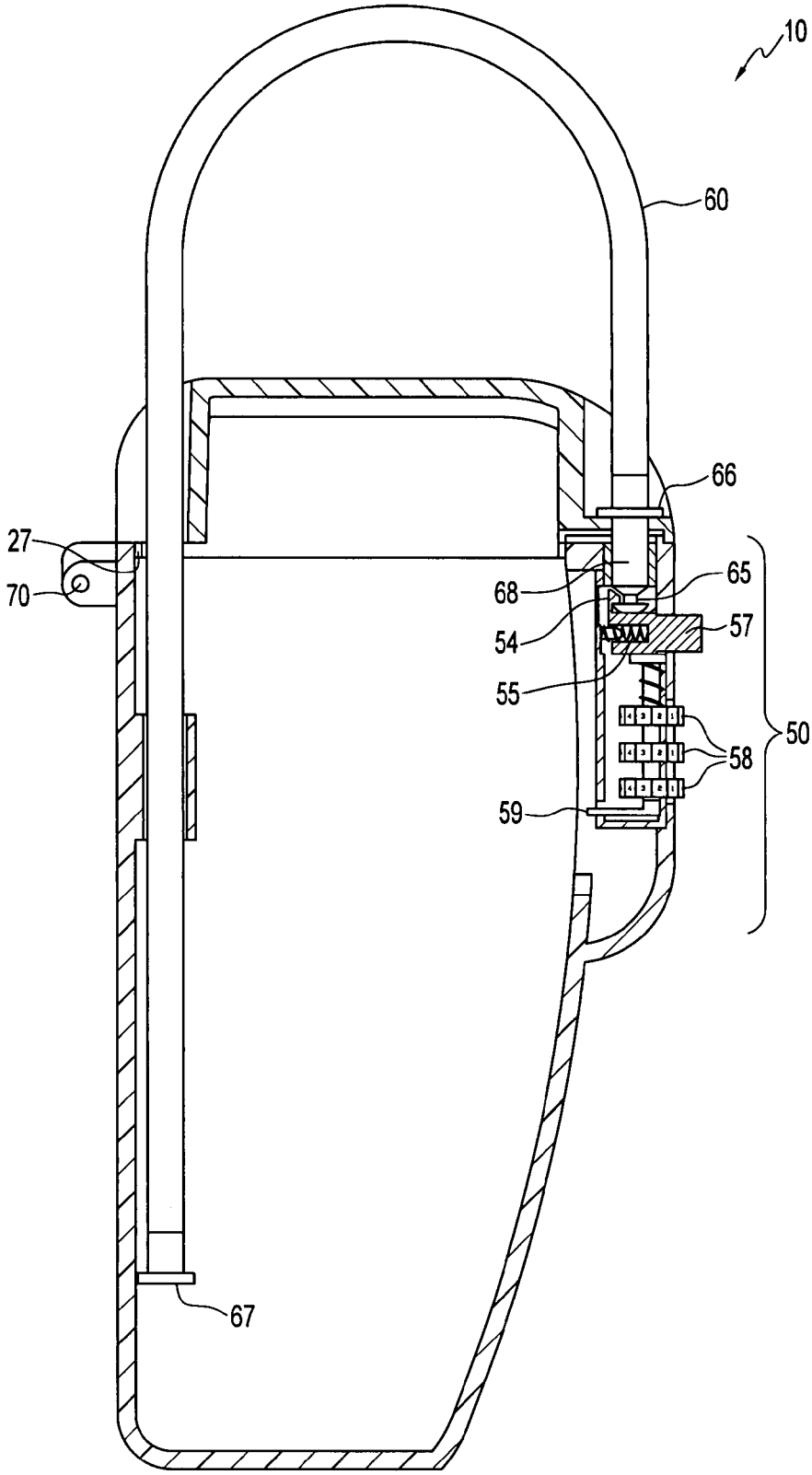
FIG. 4 is a cross-sectional view of the storage container of FIG. 3 along the lines 4-4, in accordance with one embodiment of the present invention.
Figure 5:
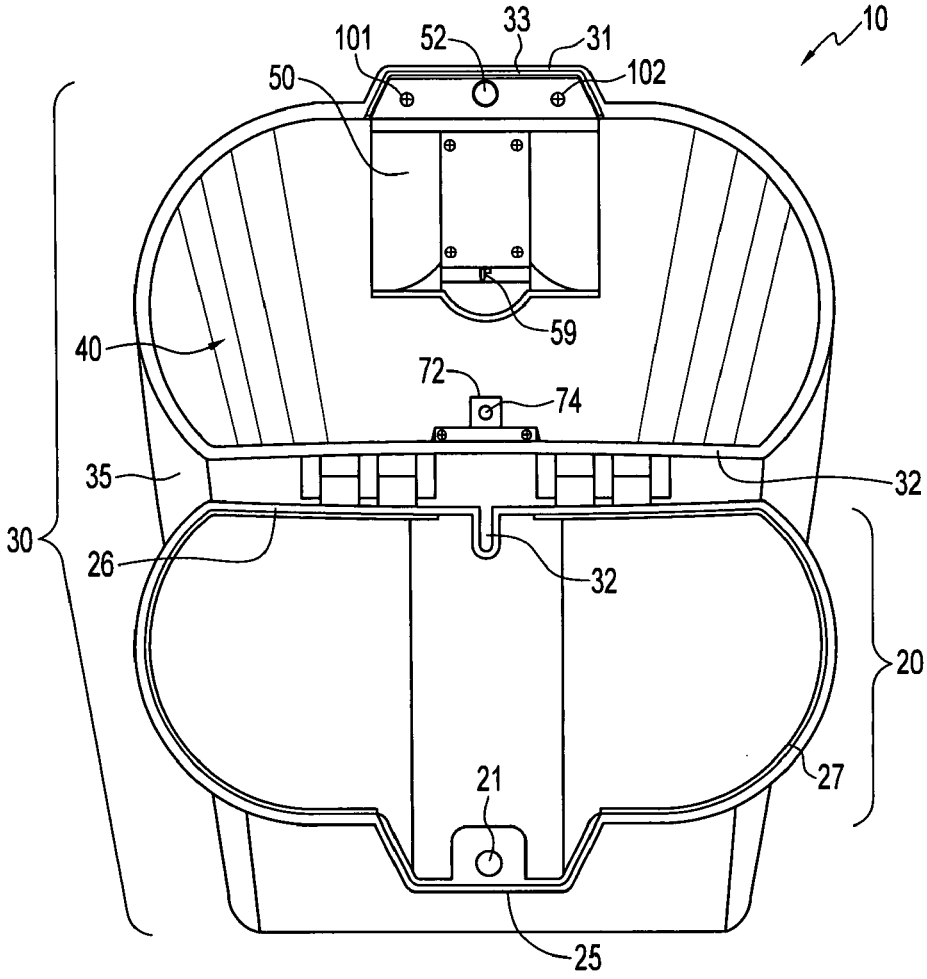
FIG. 5 is a top, rear perspective view of the storage container of FIG. 1 in an open position less the securing cable, in accordance with an embodiment of the present invention.
Figure 6:
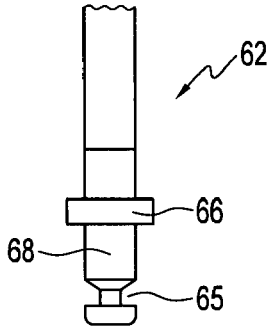
FIG. 6 is a detailed side plan view of a lockable end of an exemplary securing cable used in the storage container of FIG. 1.

The present invention can be more readily understood with reference to FIGS. 1-6, in which like reference numerals designate like items. FIGS. 1-5 depict an exemplary portable and lockable storage container 10 in accordance with one embodiment of the present invention. FIG. 6 is a detailed side plan view of one end 62 of an exemplary securing cable 60 included in the portable storage container 10 shown in FIGS. 1-5.

As depicted in FIG. 1, the exemplary storage container 10 includes a lid 20, a base 30, a locking mechanism 50, and a securing cable 60. The lid 20 is connected to the base 30 through one or more hinges 70 (two shown) located along at least part of a rear edge portion 26 of the lid 20 and a rear edge portion 32 of the base 30. The base 30 includes one or more sidewalls 35 having an inside surface 36 and an outside surface 37. The lid 20 also has an inside surface 23 and an outside surface 24. When the lid 20 is in the closed position relative to the base 30, the inside surface 36 of the base sidewalls 35 and the inside surface 23 of the lid 20 together define a chamber 40 for storing small items therein.

The lid 20 and the base 30 are preferably constructed of molded plastic having a thickness of at least 3 mm, metal (e.g., steel, titanium, aluminum, or an appropriate alloy), metal-reinforced plastic, or any other suitable material that is generally resistant to breakage. The locking mechanism 50 preferably comprises a combination lock that includes thumbwheels 58, a latch release button 57, and a combination set trigger 59. In an alternative embodiment, the locking mechanism 50 may comprise a keyed lock, an electronic lock, or any other suitable locking mechanism.

The securing cable 60 includes two end portions 62, 64 and a flexible central section 63. One end portion 62 of the securing cable cooperates with the locking mechanism 50 to lock the container 10 and retain the lid 20 in the closed position. In one embodiment as illustrated in FIG. 6, this locking end portion 62 includes a flange 66 and an extension member 68. The locking end portion 62 is preferably fabricated from stainless steel or zinc plated steel and is crimped or otherwise secured to the central section 63 of the cable 60. The other end portion 64 of the cable 60 is also preferably fabricated from stainless steel or zinc plated steel and includes a second flange 67 for use in limiting the extension of the cable 60 as discussed in detail below. The non-locking end portion 64 of the cable 60 is also crimped or otherwise secured to the central section 63 of the cable 60. The central section 63 of the cable 60 preferably comprises a multi-strand steel cable encapsulated in a plastic sheathing to provide sufficient flexibility as well as exceptional strength and resistance to being severed. Alternatively, the central section 63 of the securing cable 60 may comprise a plastic or foam-encapsulated, single-strand, steel cable or any other material that exhibits sufficient strength, flexibility and resistance to severing. The central section 63 of the securing cable 60 is sufficiently long to enable the storage container 10 to be secured to an external object, such as, for example, a tree, a chair, a table, a pole, a fence, a bike rack, or a bench.

In one embodiment, the inside surface 23 of the lid 20 includes a lip 27 extending downward along at least part, or even all, of the rear edge portion 26 and a front edge portion 25 of the lid 20. The rear edge portion 26 of the lid 20 and the front edge portion 25 of the lid are located substantially opposite one another and are separated at their furthest point by approximately the width of the lid 20. The front edge portion 25 of the lid 20 substantially aligns with the front edge portion 31 of the base 30 and the rear edge portion 26 of the lid 20 substantially aligns with the rear edge portion 32 of the base 30 when the lid 20 is in the closed position.

The lip 27 of the lid 20 is designed to allow the base 30 and the lid 20 to be at least partially in an interfitting engagement when the lid 20 is closed. For example, when the lid 20 is closed, the lip 27 of the lid 20 extends downward a sufficient amount so as to preferably touch the inside surface 36 of the base sidewall 35 so as to substantially prevent a device, such as a knife or screwdriver, from being used to pry the lid 20 open. In the embodiment depicted in FIG. 1, the edges of the lip 20 and the base 30 are continuous. Thus, in such embodiment, the front edge portion 25 of the lid 20 includes that portion of the edge of the lid 20 encompassing about the front half of the lid 20 and the rear edge portion 26 of the lid 20 includes that portion of the edge of the lid 20 encompassing about the back half of the lid 20. The lip 27 of the lid 20 may be continuous around the entire inside surface 23 of the lid 20 or, depending on the arrangement of other elements of the container 10 (e.g., the location and positioning of the locking mechanism 50), may be included along only a portion of the inside surface 23 of the lid 20.

In an alternative embodiment, the base 30 may also include a lip 33 extending upward along at least part of the front edge portion 31 of the base 30. For example, the positioning of the locking mechanism 50 along the front part of the base's sidewall 35 may prevent the lip 27 of the lid 20 from extending downward along the top part of the base's sidewall 35 along that portion of the base 30 at which the locking mechanism 50 is connected. In such a case, the part of the front edge portion 31 of the base 30 substantially corresponding to where the locking mechanism 50 is connected may include an upward-protruding lip 33 (shown in FIGS. 1 and 5) that performs the same security function around the locking mechanism 50 as is performed by the lip 27 of the lid 20 around all or most of the remainder of the container 10. Therefore, the lip 33 of the base 30, when used, is also designed to allow the base 30 and the lid 20 to be in an interfitting engagement when the lid 20 is in the closed position, at least over those portions of the lid 20 and the base 30 corresponding to the location of the base's lip 33.

The lid 20 defines an aperture 21 (shown in FIG. 5) for receiving a locking end portion 62 of the securing cable 60. The lid aperture 21 aligns substantially with a corresponding aperture 52 in the locking mechanism 50 when the lid 20 is closed. In one embodiment, the lid 20 contains a recessed area 28 near its front edge portion 25 for receiving the locking end portion 62 of the securing cable 60. The recessed area 28 includes a plurality of sidewalls 80 and a bottom surface 82. In this embodiment, the lid aperture 21 is positioned within the bottom surface 82 of the recessed area 28.

The locking mechanism 50 is connected to an inside surface 36 (e.g., the front, inside surface) of the base's sidewall 35 proximate the front edge portion 31 of the base 30. The locking mechanism 50 may be connected to the base 30 using conventional fastening means, such as, for example, screws 101, 102 as illustrated in FIG. 5. As noted above, the locking mechanism 50 includes an access aperture 52 that substantially aligns with the lid aperture 21 when the lid 20 is in the closed position. In one embodiment, the locking mechanism 50 is a combination lock that includes a spring-biased latch 54, a depressible latch release button 57, a plurality of thumbwheels 58, and a combination set button 59. The latch 54 is biased by a spring 55, which is under the control of the latch release button 57. In one embodiment, the thumbwheels 58 and the latch release button 57 are accessible through respective apertures 38, 39 in the sidewall 35 of the base 30.

Figure 2:
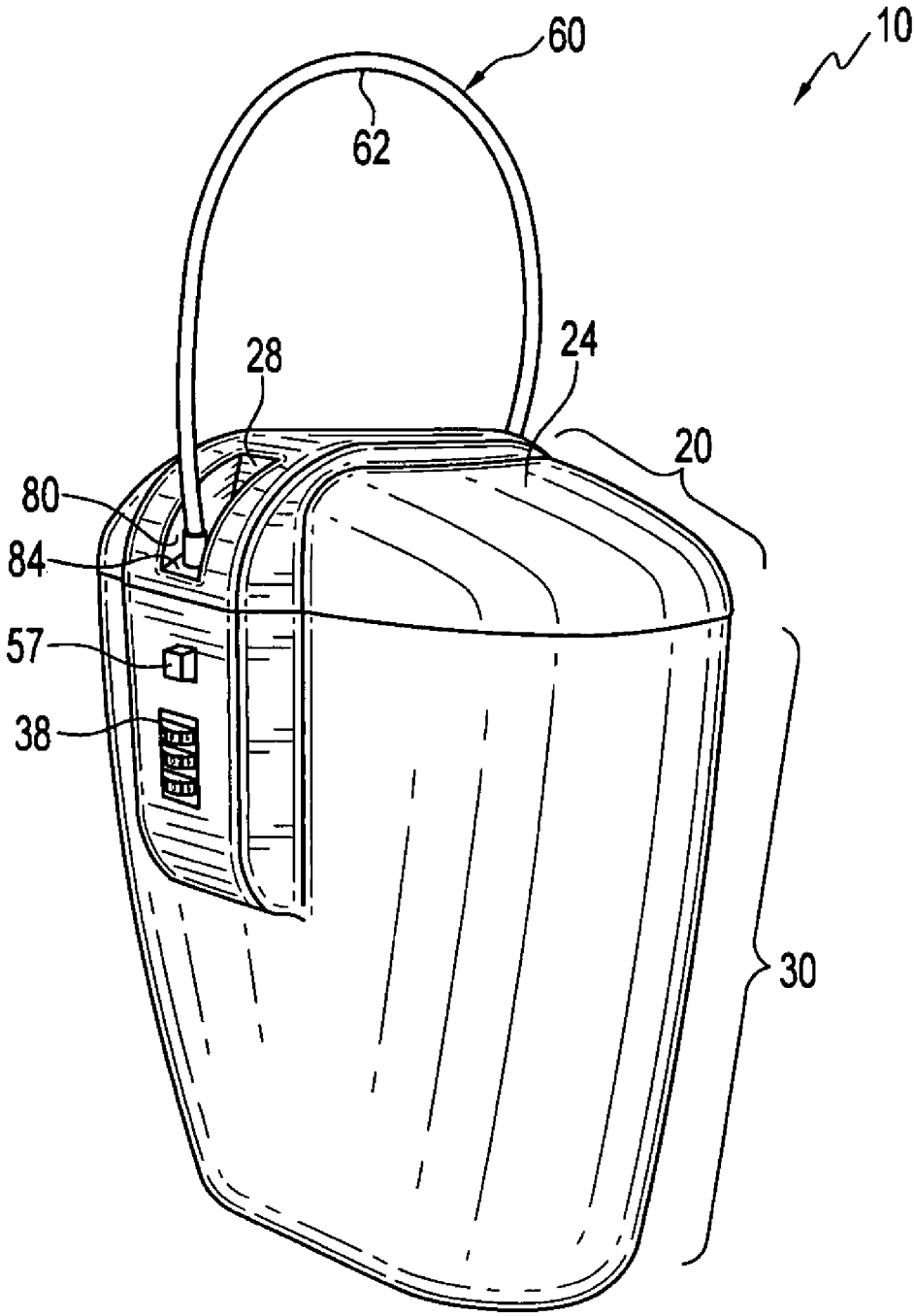
FIG. 2 is a front, right-side perspective view of the storage container of FIG. 1 with its lid in a closed position, in accordance with an embodiment of the present invention.
Figure 3:
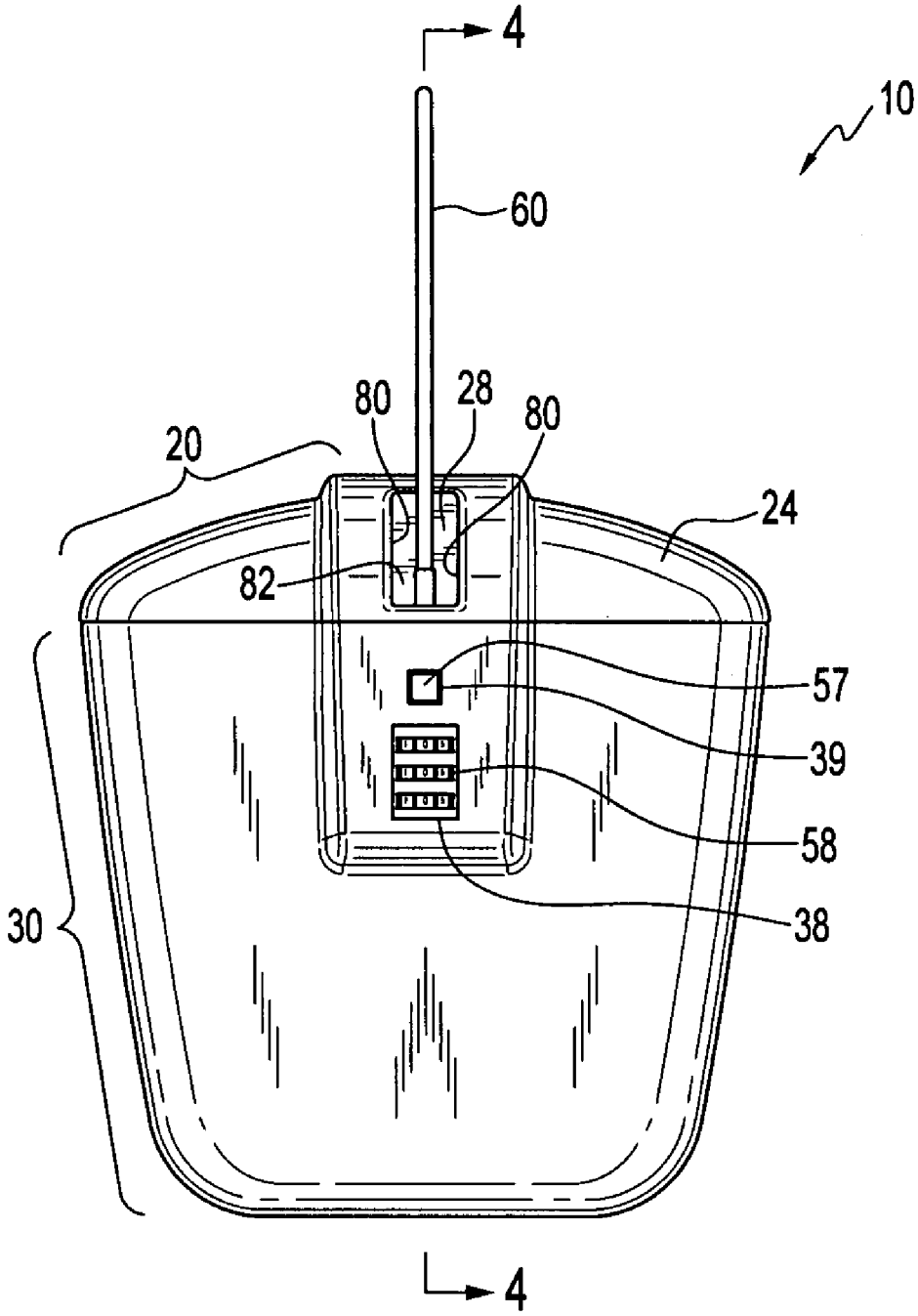
FIG. 3 is a front elevational view of the storage container of FIG. 2.

To retain the lid 20 in the closed position and thereby lock the storage container 10, the locking end portion 62 of the securing cable 60 is passed through the lid aperture 21 and the locking mechanism's access aperture 52 such that the locking end portion 62 of the cable 60 cooperates with the locking mechanism to lock the container 10. In one embodiment as illustrated in FIG. 6, the locking end portion 62 of the cable 60 includes a flange 66 and an extension member 68. The extension member 68 includes an annular recess 65 proximate a terminating end of the extension member 68. When the extension member 68 is inserted through the lid aperture 21 and the locking mechanism's access aperture 52 into the locking mechanism 50, at least part of the latch 54 engages the extension member 68 within the annular recess 65 to lock the container 10. In addition, as illustrated in FIG. 4, the flange 66 of the locking end portion 62 abuts a top, external surface of the lid 20 adjacent the lid aperture 21 (e.g., so as to surround the lid aperture 21) to retain the lid 20 in the closed position. When the lid 20 includes the recessed area 28 as illustrated in FIG. 2, the flange 66 preferably abuts the bottom surface 82 of the recessed area 28 of the lid 20 to retain the lid 20 in the closed position.

In one embodiment, the first end portion 62 of the securing cable 60 may be removed from the locking mechanism 50 by depressing the latch release button 57, which protrudes from and is accessible through a front aperture 39 in a sidewall 35 of the base 30. The latch release button aperture 39 is preferably located above an aperture 38 in the sidewall 35 through which the thumbwheels 58 are accessible when the locking mechanism 50 is a combination lock as discussed above. Alternatively, the latch release button 39 may be located elsewhere on the base 30 or the lid 20. When the latch release button 57 is depressed, the spring 55 controlled by the latch release button 57 compresses and releases the latch 54 from the annular recess 65 of the extension member 68, thereby allowing the locking end portion 62 of the cable 60 to be removed from the locking mechanism 50.

The latch release button 57 may only be depressed when the positioning of the thumbwheels 58 corresponds to a preset combination. Each thumbwheel 58 contains a plurality of positions, wherein each position corresponds to a numerical digit on a peripheral edge of the thumbwheel 57. The combination is initially set to a default positioning, such as 0-0-0. In one embodiment, the locking mechanism 50 includes a combination set trigger 59 located on a portion of the locking mechanism 50 that is inside the portable storage container 10. The trigger 59 may only be accessed when the lid 20 is in an open position relative to the base 30. The combination may be set by sliding the trigger 59 to an unengaged position and, while still holding the trigger 59, turning the thumbwheels 57 to a new combination, then releasing the trigger 59. When the thumbwheels 57 are positioned corresponding to the set combination, the locking mechanism 50 is in an unlocked position. In the unlocked position, the latch release button 57 may be depressed and the locking end portion 62 of the securing cable 60 may be removed from the locking mechanism 50. When the thumbwheels 57 are positioned in any other arrangement that does not correspond to the set combination, the latch release button 57 may not be depressed and the locking end portion 62 of the securing cable 60 cannot be removed from the locking mechanism 50, thereby retaining the lid 20 in the closed position. The locking end portion 62 of the cable 60 (e.g., extension member 68) may be inserted into the locking mechanism 50 whether the locking mechanism 50 is in the locked or the unlocked position.

The portable container 10 may also include a stop member 72 to limit the extension of the cable 60 and thereby insure that the cable 60 remains attached to whichever object the user secured it. The stop member 72 is connected to the inside surface 36 of a rear sidewall 35 or a rear portion of the sidewall 35. In one embodiment, the stop member 72 is generally rectangular-shaped, although other geometries (e.g., cylindrical or spherical) may be used, and defines an aperture 74 sized and shaped to permit the central section 63 of the securing cable 60, but not the second flange 67, to pass through. To permit the central section 63 of the cable 60 to exit the chamber 40, the lid 20 includes a second aperture 22 located proximate the rear edge portion 26 of the lid 20 and substantially opposite lid aperture 21. The rear lid aperture 22 is also sized and shaped to permit the central section 63 of the securing cable 60, but not the second flange 67, to pass through. In other words, the diameter or other maximum linear width dimension of the stop member aperture 74 and the rear lid aperture 22 is slightly greater than the diameter or maximum width of the central section 63 of the securing cable 60, but smaller than a minimum diameter or minimum width of the stopping flange 67. In an alternative embodiment, the rear lid aperture 22 may be formed as a recess or indentation along the rear edge portion 26 of the lid 20, instead of as a hole, as illustrated in FIG. 5.

To secure the exemplary storage container 10 of FIGS. 1-6 to an object, the locking end portion 62 of the securing cable 60 is passed around an external object, such as a chair or table leg. The extension member 68 of the locking end portion 62 is then passed through both the lid aperture 21 and the access aperture 52 of the locking mechanism 50, causing the spring-biased latch 54 of the locking mechanism 50 to engage the extension member 68 in the annular recess 65 thereof. The thumbwheels 58 of the locking mechanism are then rotated so as to not correspond to the combination for the locking mechanism 50, thereby preventing depression of the latch release button 57 and opening of the container 10. As noted above, the length of the securing cable 60 is sufficient to enclose varying-sized objects within a loop created by the secured cable 60, thereby substantially mitigating the likelihood of theft of the container 10 when the container 10 is secured to an object.

In the foregoing specification, the present invention has been described with reference to specific embodiments. However, one of ordinary skill in the art will appreciate that various modifications and changes may be made without departing from the spirit and scope of the present invention as set forth in the appended claims. For example, the container 10 may be any size or shape as desired by the user, the locking mechanism 50 may be any known locking mechanism capable of securing the locking end portion 62 of the securing cable 60 when such portion 62 is inserted into the locking mechanism 50 through an aperture in the lid 20, and the cable 60 may be fabricated of any suitable material that is generally flexible and resistant to severing. Accordingly, the specification and drawings are to be regarded in an illustrative rather than a restrictive sense, and all such modifications are intended to be included within the scope of the present invention.

Benefits, other advantages, and solutions to problems have been described above with regard to specific embodiments of the present invention. However, the benefits, advantages, solutions to problems, and any element(s) that may cause or result in such benefits, advantages, or solutions to become more pronounced are not to be construed as a critical, required, or essential feature or element of any or all the claims. The invention is defined solely by the appended claims including any amendments made during the pendency of this application and all equivalents of those claims as issued.

What is claimed:

1. A portable and lockable storage container comprising:

a lid defining a lid aperture therein proximate a first edge portion of the lid;

a base hingedly connected to the lid along at least part of a first edge portion of the base and a second edge portion of the lid, the second edge portion of the lid being opposite the first edge portion of the lid, the lid and the base defining a chamber when the lid is in a closed position relative to the base;

a locking mechanism connected to the base proximate a second edge portion of the base, the second edge portion of the base being opposite the first edge portion of the base and substantially aligning with the first edge portion of the lid when the lid is in the closed position, the locking mechanism defining an access aperture therein and including a spring-biased latch, the access aperture being substantially aligned with the lid aperture when the lid is in the closed position; and a securing cable that includes a first end portion, wherein the first end portion of the securing cable defines an annular recess and is adapted to be passed through the lid aperture and the access aperture such that the annular recess receives at least tart of the latch to retain the lid in the closed position.

2. The storage container of claim 1, wherein the lid includes an inside surface and an outside surface, and wherein the inside surface of the lid includes a lip extending downward along at least part of the first edge portion and the second edge portion of the lid, the lip being designed to allow the base and the lid to be at least partially in an interfitting engagement when the lid is in the closed position.

3. The storage container of claim 1, wherein the base includes a lip extending upward along at least part of the second edge portion of the base, the lip being designed to allow the base and the lid to be at least partially in an interfitting engagement when the lid is in the closed position.

4. The storage container of claim 1, wherein a length of the securing cable is sufficient to enable the storage container to be secured to an object.

5. A portable and lockable storage container comprising:

a lid defining a lid aperture therein proximate a first edge portion of the lid;

a base hingedly connected to the lid along a least part of a first edge portion of the base and a second edge portion of the lid, the second edge portion of the lid being opposite the first edge portion of the lid, the lid and the base defining a chamber when the lid is in a closed position relative to the base;

a locking mechanism connected to the base proximate a second edge portion of the base, the second edge portion of the base being opposite the first edge portion of the base and substantially aligning with the first edge portion of the lid when the lid is in the closed position, the locking mechanism defining an access aperture therein that aligns substantially with the lid aperture when the lid is in the closed position; and a securing cable having a first end portion and a second end portion, the first end portion of the securing cable including a flange and an extension member, wherein the flange is designed to abut a top, external surface of the lid so as to surround the lid aperture and the extension member is designed to pass through the lid aperture and the access aperture into the locking mechanism, thereby causing the lid to be locked in the closed position.

6. The storage container of claim 5, wherein the base includes at least one sidewall that defines a wall aperture therein, wherein the locking mechanism includes a combination lock having a plurality of thumbwheels, and wherein the thumbwheels of the combination lock are accessible through the wall aperture.

7. The storage container of claim 6, wherein the locking mechanism further includes a spring-biased latch and a depressible latch release button, wherein the extension member of the securing cable defines an annular recess, and wherein the at least one sidewall of the base further defines a second wall aperture therein, at least part of the latch engaging the extension member within the annular recess when the extension member is passed through the lid aperture and the access aperture into the locking mechanism, the latch release button being accessible through the second wall aperture and causing the latch to become disengaged from the extension member when pressed.

8. The storage container of claim 7, wherein the second wall aperture is positioned above the wall aperture.

9. The storage container of claim 5, wherein the lid further defines a recessed area proximate the first edge portion of the lid, the recessed area including a plurality of sidewalls and a bottom surface, and wherein the lid aperture is positioned within the bottom surface.

10. The storage container of claim 5, wherein the base includes at least one sidewall having an inside surface and an outside surface, the inside surface of the at least one sidewall being non-accessible when the lid is in the closed position, wherein the securing cable further includes a flexible central section positioned between the first end portion and the second end portion of the securing cable, the second end portion of the securing cable including a second flange, and wherein the storage container further comprises:

a stop member connected to the inside surface of the at least one sidewall and defining a stop member aperture sized and shaped to permit the central section, but not the second flange, of the securing cable to pass therethrough.

11. The storage container of claim 10, wherein the lid defines a second lid aperture positioned proximate the second edge portion of the lid and substantially opposite the lid aperture, the second lid aperture being sized and shaped to permit the central section, but not the flange, of the securing cable to pass therethrough.

12. The storage container of claim 5, wherein a length of the securing cable is sufficient to enable the storage container to be secured to an object.

13. The storage container of claim 5, wherein the lid includes an inside surface and an outside surface, and wherein the inside surface of the lid includes a lip extending downward along at least part of the first edge portion and the second edge portion of the lid, the lip being designed to allow the base and the lid to be at least partially in an interfitting engagement when the lid is in the closed position.

14. The storage container of claim 5, wherein the base includes a lip extending upward along at least part of the second edge portion of the base, the lip being designed to allow the base and the lid to be at least partially in an interfitting engagement when the lid is in the closed position.

15. A portable and lockable storage container comprising:

a lid defining a lid aperture therein proximate a front edge portion of the lid;

a base hingedly connected to the lid along a least part of a rear edge portion of the base and a rear edge portion of the lid, the rear edge portion of the lid being opposite the front edge portion of the lid, the base including at least one sidewall having an inside surface and an outside surface, the inside surface of the at least one sidewall being non-accessible when the lid is in a closed position relative to the base, the lid and the base defining a storage chamber when the lid is in the closed position;

a locking mechanism connected to the base proximate a front edge portion of the base, the front edge portion of the base being opposite the rear edge portion of the base and substantially aligning with the front edge portion of the lid when the lid is in the closed position, the locking mechanism defining an access aperture therein that aligns substantially with the lid aperture when the lid is in the closed position;

a securing cable having a first end portion, a second end portion, and a flexible central section positioned between the first end portion and the second end portion, the first end portion of the securing cable including a first flange and an extension member, the second end portion of the securing cable including a second flange, wherein the first flange is designed to abut an external surface of the lid adjacent the lid aperture and the extension member is designed to pass through the lid aperture and the access aperture into the locking mechanism, thereby causing the lid to be locked in the closed position; and a stop member connected to the inside surface of the at least one sidewall of the base and defining a stop member aperture sized and shaped to permit the central section, but not the second flange, of the securing cable to pass therethrough, the stop member limiting extension of the securing cable during use of the storage container.

16. The storage container of claim 15, wherein the least one sidewall of the base defines a first wall aperture and a second wall aperture therein such that the first wall aperture is positioned above the second wall aperture, wherein the locking mechanism includes a combination lock having a plurality of thumbwheels, a spring-biased latch and a depressible latch release button, and wherein the extension member of the securing cable defines an annular recess, the thumbwheels of the combination lock being accessible through the second wall aperture, at least part of the latch engaging the extension member within the annular recess when the extension member is passed through the lid aperture and the access aperture into the locking mechanism, and the latch release button being accessible through the first wall aperture and causing the latch to become disengaged from the extension member when pressed.

17. The storage container of claim 15, wherein the lid defines a second lid aperture positioned proximate the rear edge portion of the lid, the second lid aperture being sized and shaped to permit the central section, but not the second flange, of the securing cable to pass therethrough.

18. The storage container of claim 15, wherein a length of the securing cable is sufficient to enable the storage container to be secured to an object.

19. The storage container of claim 15, wherein the lid includes an inside surface and an outside surface, and wherein the inside surface of the lid includes a lip extending downward along at least part of the front edge portion and the rear edge portion of the lid, the lip being designed to allow the base and the lid to be at least partially in an interfitting engagement when the lid is in the closed position.

20. The storage container of claim 15, wherein the inside surface of the at least one sidewall of the base includes a lip extending upward along at least part of the front edge portion of the base, the lip being designed to allow the base and the lid to be at least partially in an interfitting engagement when the lid is in the closed position.

* * * * *